United States Patent [19]

LaFaver

[11] 4,110,849

[45] Sep. 5, 1978

[54] APPARATUS AND METHOD FOR CONSERVING WATER

[76] Inventor: Edward B. LaFaver, 3116 Maple Way, Granger, Utah 84119

[21] Appl. No.: 774,836

[22] Filed: Mar. 7, 1977

[51] Int. Cl.[2] ..... A47K 1/34; A47K 5/02; A61B 19/00

[52] U.S. Cl. ..... 137/435; 4/378; 4/415

[58] Field of Search ..... 4/57 R, 57 P, 67 A, 4/67 R, 34, 37, 38, 55, 52, 63, 56, 54, 53, 18 A

[56] References Cited

U.S. PATENT DOCUMENTS

| | | | |
|---|---|---|---|
| 1,364,891 | 1/1921 | Schossow | 4/55 |
| 2,702,908 | 3/1955 | Thorndike | 4/38 X |
| 2,773,268 | 12/1956 | Hurko et al. | 4/63 X |
| 3,108,286 | 10/1963 | Moore | 4/55 |
| 3,932,900 | 1/1976 | Huston et al. | 4/56 |
| 3,936,889 | 2/1976 | Wibroe | 4/37 |

FOREIGN PATENT DOCUMENTS

| | | | |
|---|---|---|---|
| 92,048 | 4/1938 | Sweden | 4/55 |

*Primary Examiner*—Henry K. Artis
*Attorney, Agent, or Firm*—H. Ross Workman; J. Winslow Young

[57] ABSTRACT

An apparatus and method for conserving water during the flush cycle of a tank-type toilet. The apparatus includes a pivotally mounted lever arm having a water-fillable weight on one end and a toilet tank float engagement means on the other end. The water-fillable weight serves as a counter balance to maintain the toilet tank float in an elevated position to thereby hold the water inlet valve closed during the initial stages of the flush cycle. The apparatus also includes means for mounting the pivot mechanism in the toilet tank. The method involves slowly draining water from the water-fillable weight during the flush cycle so as to allow the toilet tank float to be lowered toward the end of the flush cycle and thereby open the inlet valve to refill the toilet tank.

8 Claims, 5 Drawing Figures

APPARATUS AND METHOD FOR CONSERVING WATER

BACKGROUND

1. Field of the Invention

This invention relates to tank-type toilets and, more particularly, to an apparatus and method for conserving water during the flush cycle of the toilet.

2. The Prior Art

The conventional tank-type water closet or toilet is configurated with a water reservoir or tank located above and to the rear of the pedestal. An outlet from the tank directs water into the pedestal where it flushes the wastes therein into the sewer system. A manually operable stopper occludes the outlet and serves as the mechanism for initiation of the flush cycle. A float mechanism inside the tank senses the water level to operate a water inlet valve and replenish the water in the tank after each flush cycle. The flush cycle is commenced by (1) raising the stopper to allow the water in the tank to flush the pedestal,
(2) the lowering water level in the tank causing
(3) the float to fall and thereby
(4) opening the inlet valve to permit refilling of the tank before the stopper has again closed.

As can be readily observed, the foregoing opening of the inlet valve to refill the tank before the stopper has closed directs water from the inlet valve to the drain. However most conventional toilets are configurated such that there is a sufficient reservoir of static water available in the toilet tank to accomodate a complete suitable flushing of the toilet. The extra water contributed by the premature opening of the inlet valve is generally wasted. For example, it has been estimated that a conventional toilet tank contains a water reservoir of about 4½ gallons. This is generally considered to be adequate for the flushing cycle. It has also been determined that opening of the inlet valve prior to the cessation of the flushing cycle results in about 1½ gallons of additional water being used for the flushing cycle and, thereby, wasted.

When consideration is given to the millions of tank-type toilets in use both in residential and commercial buildings, the amount of water wasted during the flushing cycle represents a significant quantity of water. Additionally, since the wasted water is not required for suitably flushing the toilet, the additional water contributes to overloading of sewage treatment facilities. Various water conservancy devices have been proposed and include, for example, the placement of bricks or the like as displacement means in the toilet tank to displace an equal volume of water thereby reducing the total volume of water used in the flushing cycle.

In view of the foregoing, it would be a significant advancement in the art of conserving water, particularly during the flushing cycle of a tank-type toilet, by restraining the toilet tank float until a significant quantity of the static water in the toilet tank has been drained therefrom and thereafter allowing the toilet tank float to be lowered so as to open the inlet valve to refill the toilet tank. It would also be an advancement in the art to provide an apparatus which can be readily adapted to be placed in various commercial models of toilet tanks. An even further advancement in the art would be to provide a method for suitably controlling the lowering of the toilet tank float substantially automatically. Such an apparatus and method is disclosed and claimed in the present invention.

BRIEF SUMMARY AND OBJECTS OF THE INVENTION

The novel apparatus and method of this invention involves a pivotally mounted lever arm having a toilet tank float engagement means on one end and a water-fillable weight on the other end. The weight of the water in the water-fillable weight is sufficient to substantially support the weight of the toilet tank float engaged by the engagement means. A calibrated drain hole is provided in the water-fillable weight to accommodate draining of the water therefrom. Drainage of the water from the water-fillable weight provides a predetermined time delay to change the balance of the lever arm thereby allowing the toilet tank float to be lowered toward the end of the draining of the tank. The lowered float opens the inlet valve and the toilet tank is again refilled with water from the inlet valve. The size of the calibrated drain opening is predetermined so as to delay lowering of the toilet tank float until substantially all of the water has been drained from the toilet tank thereby conserving water by inhibiting its being wasted by going directly out the drain.

It is, therefore, a primary object of this invention to provide an apparatus for conserving water during the flush cycle of a tank-type toilet.

Another object of this invention is to provide an improved method for conserving water during the flushing cycle of a tank-type toilet.

Another object of this invention is to provide a lever arm with means for engaging a toilet tank float at one end and a variable weight counterbalance on the other end wherein the variable weight is provided by a water-fillable weight.

Another object of this invention is to provide means for releasably engaging the apparatus of this invention inside the tank of a tank-type toilet.

These and other objects and features of the present invention will become more fully apparent from the following description and appended claims taken in conjunction with the accompanying drawing.

DETAILED DESCRIPTION OF THE PREFERRED EMBODIMENTS

Figure 1:
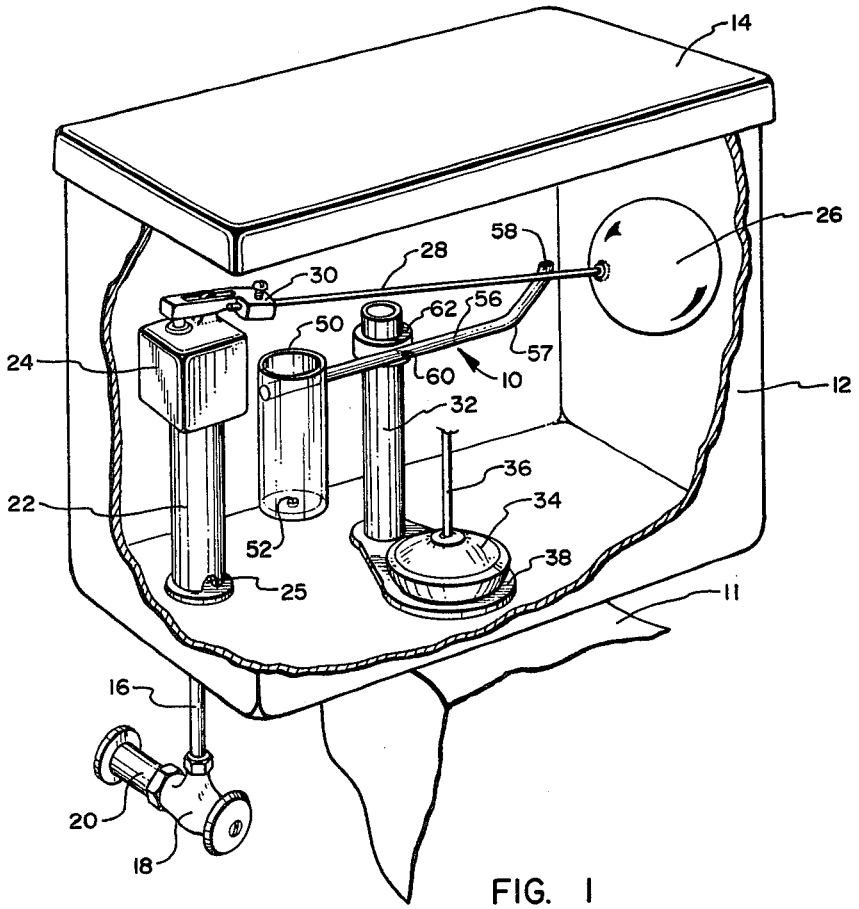
FIG. 1 is a schematic perspective view of the internal mechanism of a tank-type toilet shown in the partial environment of a toilet pedestal with portions broken away for purposes of clarity.

The invention is best understood by reference to the drawing wherein like parts are designated with like numerals throughout.

Figure 2:
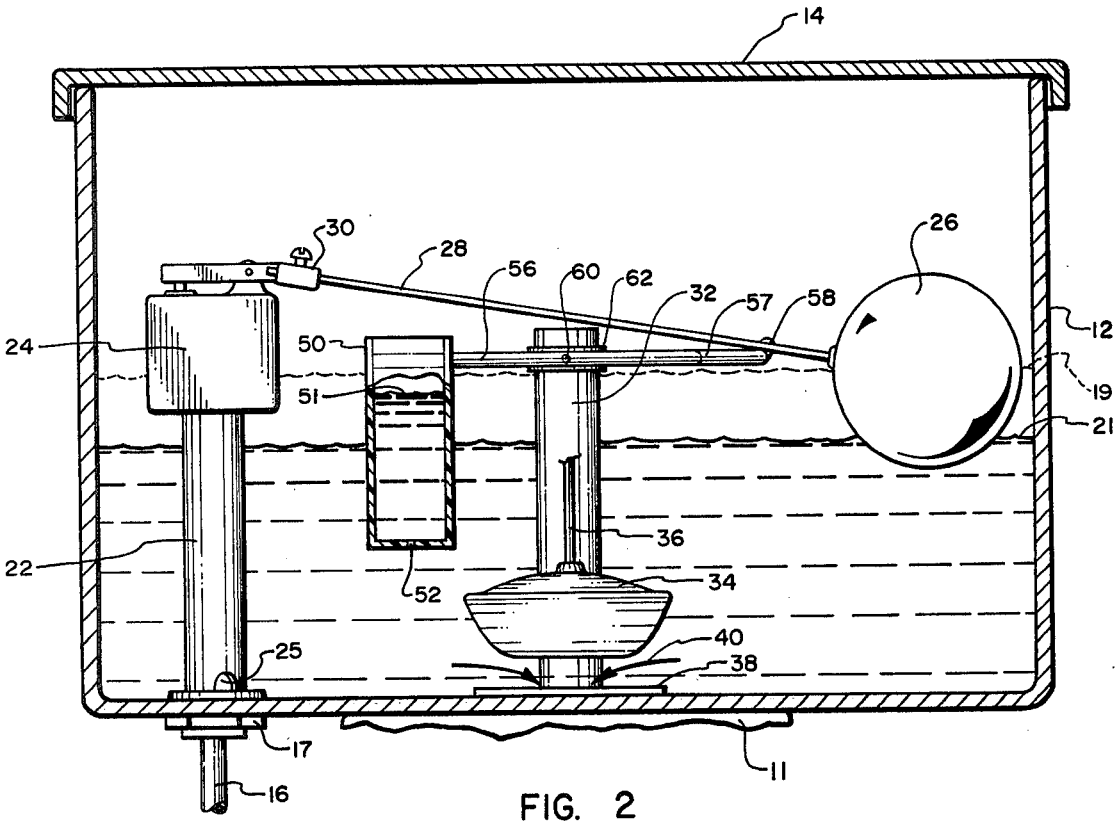
FIG. 2 is a side elevation of the internal mechanism of the toilet tank apparatus of FIG. 1 during the initial stages of the flushing cycle with portions broken away for sake of clarity.
Figure 3:
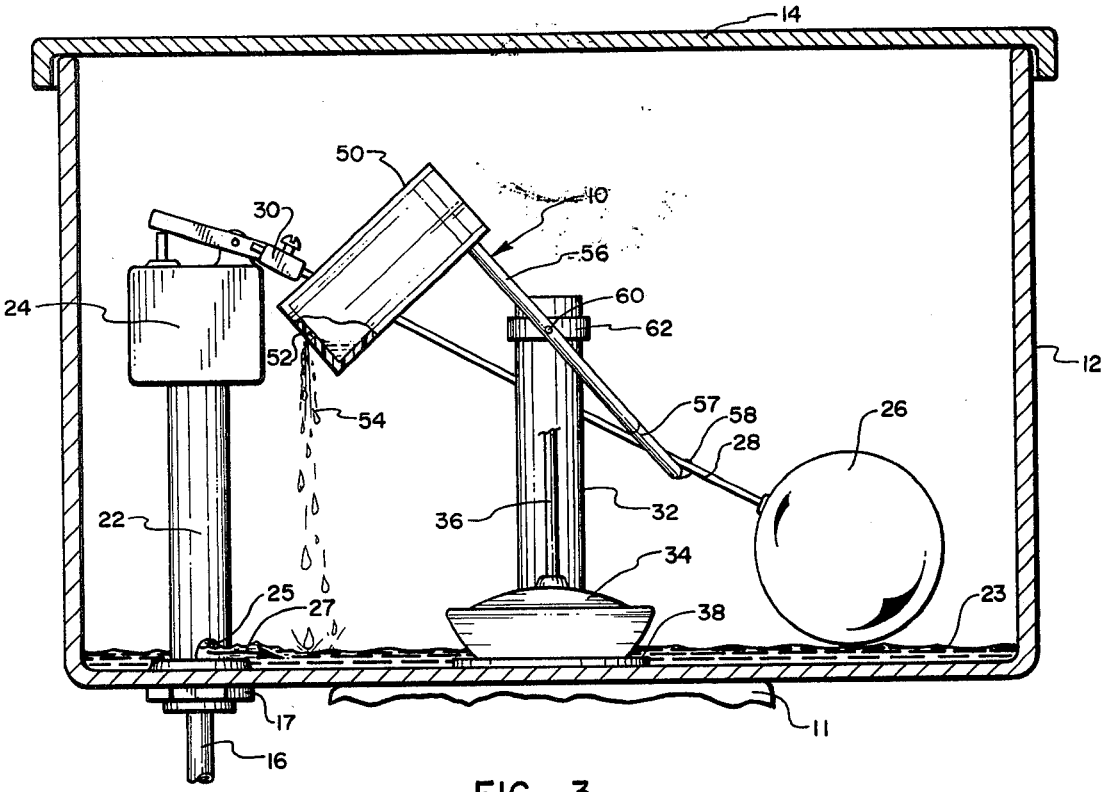
FIG. 3 is a side elevation of the toilet tank mechanism of FIGS. 1 and 2 near the completion of the flushing cycle with portions broken away for sake of clarity.

Referring now to FIGS. 1–3, the water saver apparatus of this invention is shown generally at 10 as mounted in a conventional toilet tank 12 so as to be concealed therein beneath toilet tank lid 14. Toilet tank 12 is a conventional toilet tank and is mounted in fluid communication with a toilet pedestal (shown herein broken away as toilet pedestal 11). Toilet tank 12 is interconnected to a water inlet line 16 and is supplied with water from a water shut-off valve 18 in a water supply line 20.

Toilet tank 12, lid 14, water inlet line 16, shut-off valve 18 and water supply line 20 are all conventional apparatus. Other conventional apparatus include an inlet standpipe 22, a water inlet 25, and a water inlet valve 24 which is interconnected to a toilet tank float 26 by means of float rod 28 and a bracket 30. Other conventional components include an overflow standpipe 32, drain stopper 34, lift rod 36, and drain valve seat 38. These conventional components are set forth herein so as to provide an appropriate environment to assist in understanding the novel apparatus and method of this invention. The operation of these conventional components will not be discussed in depth except as they relate to the operation of the apparatus and method of this invention. Although a particular type of toilet tank may be illustrated herein, it is to be specifically understood that the apparatus and method of this invention is not restricted to use in a toilet tank having the specific components shown but may be readily adapted to various commercial models of tank-type toilets.

With particular reference to the novel apparatus and method of this invention, the water saver 10 includes a lever arm 56 having a water-fillable weight 50 on one end and a toilet tank float engagement means 58 on the other end. Toilet tank float engagement means 58 is configurated as an upwardly turned hook in the end of an arm 57 formed on the end of lever 56. Toilet tank float engagement means 58 is specifically configurated to restrain toilet tank float 26 by being engaged beneath float rod 28.

Lever arm 56 is pivotally mounted to overflow standpipe 32 by means of a pivot pin 60 secured to a retaining ring 62. Retaining ring 62 is dimensionally configurated to be releasably mounted to overflow standpipe 32 at a position adjacent an upper level 19 (shown in broken lines, FIG. 2) of water in toilet tank 12.

Water-fillable weight 50 is configurated as an open end container secured to the end of lever arm 56 and includes a calibrated drain hole 52 in the bottom thereof. The volume of water-fillable weight 50 is coordinated with the length of lever arm 56 on each side of pivot 60 and the combined weight of toilet tank float 26 and float rod 28 so as to adequately support toilet tank float 26 above the receding water level (illustrated schematically at 21, FIG. 2) during the flushing cycle. Importantly, as stopper 34 is raised and water is allowed to flow outwardly from tank 12 as indicated by flow arrows 40, sufficient water is retained within water-fillable float 50 so as to impede the lowering of toilet tank 26. The opening of inlet valve 24 is thereby suitably delayed until a substantial quantity of water has been drained from toilet tank 12.

Since it is desirable to have toilet tank float 26 ultimately lowered thereby opening inlet valve 24, a calibrated opening 52 is provided in the bottom of water-fillable weight 50. Accordingly, as the water level 21 (FIG. 2) drops in toilet tank 12 the water level in water-fillable weight 50 also starts to lower as indicated schematically at 51 (FIG. 2).

With particular reference to FIG. 3, the toilet tank mechanism is shown at the completion of the flush cycle with the stopper 34 again seated against valve seat 38 and toilet tank float 26 in its lowered position thereby opening valve 24. The lowering of toilet tank float 26 is accommodated by drainage of water, indicated schematically herein as water 54, through drain hole 52 so that the weight of the water-fillable weight 50 is overcome by the combined weight of toilet tank float 26 and float rod 28. The size of drain hole 52 is predetermined with respect to the volume of water contained in water-fillable weight 50 so as to provide a sufficient time delay between the raising of stopper 34 and its subsequent lowering into sealing relationship with valve seat 38. In this presently preferred embodiment of the invention, drain hole 52 is configurated to slowly drain water from water-fillable weight 50 at such a rate that the toilet tank 12 is substantially drained and stopper 34 is again seated on valve seat 38 before any substantial degree of opening of valve 24 is obtained by lowering of toilet tank float 26. Clearly, however, any suitable delay can be selectively predetermined for water-fillable weight 50 by selectively determining the opening of drain aperture 52 and, therefore, the rate at which water flows therethrough.

Figure 4:
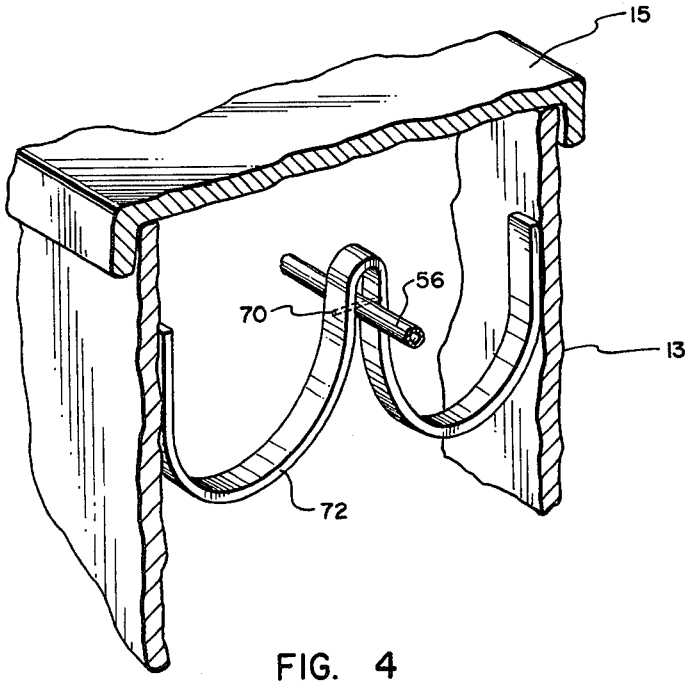
FIG. 4 is a perspective view of one preferred embodiment of the apparatus for releasably mounting the apparatus of this invention in a toilet tank with portions broken away for sake of clarity.

Referring now more particularly to FIG. 4, one preferred embodiment for securing a pivot 70 for lever arm 56 in a toilet tank 13 is shown and includes a spring clip 72 formed from a strip of resilient material. Spring clip 72 is fabricated with a configuration generally representing the letter W. The distance across the W configuration of spring clip 72 is greater than the internal dimensions of toilet tank 13 to thereby advantageously utilize the outwardly pressing force of spring clip 72 when the same is inserted into toilet tank 13.

Although spring clip 72 is shown generally in the form of the letter W, it could be readily reversed in its orientation so as to generally represent the letter M. Alternatively, the two ends of spring clip 72 could be joined so as to form a continuous loop below lid 15. Importantly, regardless of the configuration chosen, spring clip 72 is configurated to pivotally support lever arm 56 in the desired location in tank 13 and to avoid interference with the movement of toilet tank float 26 and float rod 28.

Figure 5:
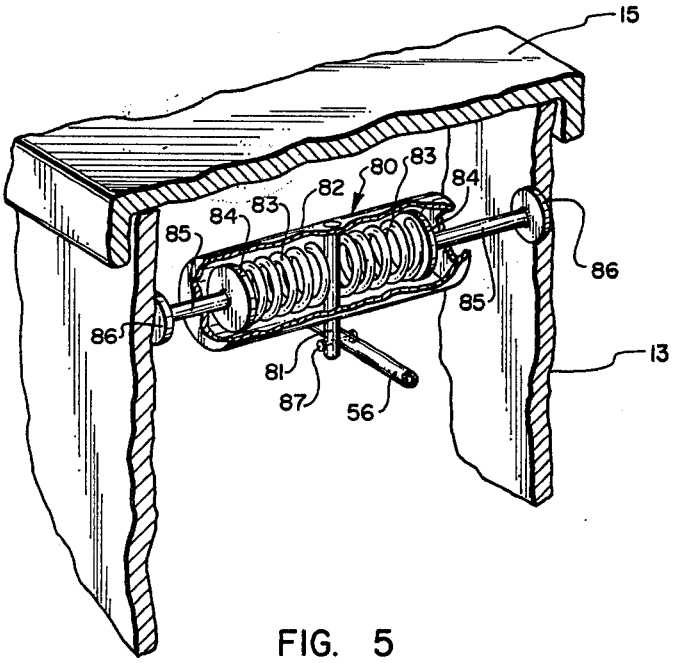
FIG. 5 is a perspective view of a another preferred embodiment for releasably engaging the apparatus of this invention in a toilet tank with portions broken away for sake of clarity.

Referring now more particularly to FIG. 5, another preferred embodiment for securing a pivot 87 for lever arm 56 in a toilet tank 13 is illustrated generally as a bracket 80. Bracket 80 is fabricated from a cylinder 82 with a spring-biased rod 85 extending from each end. Rod 85 is configurated with a piston 84 in engagement with a spring 83 at one end and termintes in a foot 86 at the other end. Spring 83 is configurated as a compression spring and resilently urges rod 85 and, more particularly, foot 86 against the inside walls of toilet tank 13.

Bracket 80 is mounted in toilet tank 13 by first removing lid 15 and pushing rods 85 inwardly to compress spring 83 while lowering bracket 80 into position into toilet tank 13. Pivot 87 is supported on the end of a downwardly depending shaft 81 extending from bracket 80. In this manner, pivot 87 for lever arm 56 is selectively located at the appropriate position in toilet tank 13. Preferably, bracket 80 and, more particularly, pivot 87 is suitably adjusted in toilet tank 13 so that pivot 87 is adjacent the upper level of water in toilet tank 13 as set forth with respect to pivot 60 and water level 19 of FIG. 2.

THE METHOD

The method of this invention involves placing the water saver apparatus 10 in a toilet tank by pivotally supporting lever arm 56 therein either by means of pivot 60 (FIGS. 1–3), pivot 70 (FIG. 4), or pivot 87 (FIG. 5). In each configuration, lever arm 56 is pivotally suspended in the appropriate toilet tank at a position adjacent the upper level 19 (FIG. 2) of the water therein. The water-fillable weight 50 is thereby immersed in the water to accommodate filling with water by forcing the water through the drain aperture 52.

Upon commencing the flush cycle for the toilet tank 12 (FIGS. 1–3) by raising rod 36 and, correspondingly, stopper 34, the desired water conservation sequence provided by water saver 10 is commenced. In particular, as the water level (water level 21, FIG. 2) drops away from both water-fillable weight 50 and toilet tank float 26 the level of water (water level 51, FIG. 2) in water-fillable weight 50 also lowers but at a slower rate than water level 21. Accordingly, sufficient weight is imparted to the end of lever arm 56 so as to support the weight of toilet tank float 26 and thereby suspend the same above the lowering water level 21 (FIG. 2). After sufficient water has drained from drain aperture 52, the residual weight of water-fillable weight 50 is overcome by the combined weight of toilet tank float 26 and float rod 28 thereby lowering toilet tank float 26 and opening inlet valve 24. With inlet valve 24 opened, the inrushing water 27 from inlet port 25 refills toilet tank 12 (FIG. 3), preferentially, after stopper 34 is again reseated on valve seat 38.

As the lowered water level (water level 23, FIG. 3) raises through the action of the inrushing water 27, toilet tank float 26 correspondingly rises allowing water-fillable weight 50 to be lowered into contact with the rising water level. Thereafter, the rising water level enters water-fillable weight 50 through drain aperture 52 again refilling water-fillable weight 50. Accordingly, the water saver apparatus 10 is again functionally prepared to operate on the next flush cycle of the toilet.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A water saver for a toilet tank having a water-supported toilet tank float mounted on a toilet tank float lever arm and operable therethrough to open a water inlet valve into the toilet tank upon lowering the toilet tank float from an elevated position by draining water from the toilet tank, the water saver comprising:

means for restraining the toilet tank float at an elevated position while water is draining from the toilet tank during flushing of the toilet comprising:

a water saver lever arm;

a water-fillable weight on one end of the water saver lever arm;

toilet tank float engagement means on the other end of the water saver lever arm;

pivot support means in the toilet tank for pivotally supporting the water saver lever arm at a position between the water-fillable weight on the one end of the water saver lever arm and the toilet tank float engagement means on the other end of the water saver lever arm; and an aperture in the water-fillable weight to accommodate passage of water into and out of the water-fillable weight; and means for releasing the toilet tank float after a major portion of the water has drained from the toilet tank.

2. The water saver defined in claim 1 wherein the aperture comprises the means for releasing and is specifically coordinated in size to the volume of water-fillable weight and the rate of drainage of water from the toilet tank during a flushing operation so as to drain water from the water-fillable weight to thereby decrease the weight of the water-fillable weight and allow the toilet tank float to be lowered after a major portion of the water has been drained from the toilet tank during a flushing operation, the lowered toilet tank float opening the inlet valve to the toilet tank through movement of the toilet tank float lever arm.

3. The water saver defined in claim 1 wherein the pivot support means comprises a collar adapted to be releasably secured to an overflow standpipe in a toilet tank and a pivot pin secured to the collar at a position to pivotally support the lever arm.

4. The water saver defined in claim 1 wherein the pivot support means comprises a spring clip means for spring engagement with the internal walls of the toilet tank to hold the pivot for the lever arm at a preselected position in the toilet tank.

5. The water saver defined in claim 4 wherein the spring clip means comprises a strip of material having a degree of resiliency and formed into a curvilinear configuration, the curvilinear configuration having a length slightly greater than the width of the toilet tank so as to accommodate pressing outwardly against the inside walls of the toilet tank and thereby provide a support for the pivot.

6. The water saver defined in claim 4 wherein the spring clip means comprises a hollow member having at least one piston member slidingly cooperating therewith and spring means for resiliently urging the piston member outwardly with respect to the hollow member so as to engage the inside walls of the toilet tank and a column extending transversely from at least one of the hollow member and the piston member, the column serving as a support base for the pivot for the lever arm.

7. A method for conserving water during a flushing cycle of a tank-type toilet by inhibiting inflow of water into the toilet tank during a substantial portion of the flushing cycle of the toilet comprising the steps of:

pivotally mounting a water saver lever arm inside the toilet tank, the toilet tank including a toilet tank float mounted on a toilet tank float lever arm and a water inlet valve operated through the toilet tank float lever arm by movement of the toilet tank float, the water saver lever arm having an engagement means on one end for engaging the toilet tank float and a water-fillable weight on the other end, the water-fillable weight having a small drain hole therein;

engaging the toilet tank float with the water saver lever arm engagement means;

filling the water-fillable weight with water;

conserving water by restricting inflow of water into the toilet tank from the water inlet valve while draining the toilet tank during flushing of the toilet by holding the toilet tank float above the diminishing water level in the toilet tank with the weight of the water in the water-fillable weight until a substantial portion of the water in the toilet tank has been drained therefrom; and draining water from the water-fillable weight thereby decreasing the weight of the same to accommodate lowering of the toilet tank float and toilet tank float lever arm thereby opening the water inlet valve to allow the inflow of water into the toilet tank.

8. The method as defined in claim 7 wherein the filling step comprises immersing the drain hole portion of the water-fillable weight in the water in the toilet tank while forcing water through the drain hole into the water-fillable weight.

* * * * *